United States Patent [19]

Vote

[11] Patent Number: 5,063,840

[45] Date of Patent: Nov. 12, 1991

[54] PULP PRESS VAT PROVIDING ENHANCED BOTTOM ACCESS

[75] Inventor: Andrew S. Vote, Lexington, Mass.

[73] Assignee: Ingersoll-Rand Company, Woodcliff Lake, N.J.

[21] Appl. No.: 560,850

[22] Filed: Jul. 27, 1990

[51] Int. Cl.[5] ..... B30B 9/20

[52] U.S. Cl. ..... 100/121; 100/156; 220/211; 366/77

[58] Field of Search ..... 100/37, 110, 121, 156, 100/173, 174, 176; 210/326, 402, 404; 162/323-335, 357, 358; 220/211; 366/77, 83, 84, 85; 49/332

[56] References Cited

U.S. PATENT DOCUMENTS

| | | | |
|---|---|---|---|
| 1,234,526 | 7/1917 | Banbury | 366/77 |
| 1,238,624 | 8/1917 | Becker | 49/332 |
| 2,350,603 | 6/1944 | Fry | 100/156 |
| 2,915,005 | 12/1959 | Hetzler | 100/121 |
| 2,994,100 | 8/1961 | Comes et al. | 366/77 |
| 3,369,324 | 2/1968 | Tremblay et al. | 220/211 X |
| 3,695,587 | 10/1972 | De Marco | 366/77 |
| 4,543,161 | 9/1985 | Fujimoto | 100/121 X |
| 4,729,490 | 3/1988 | Ziegenbein | 220/211 |

FOREIGN PATENT DOCUMENTS

| | | | |
|---|---|---|---|
| 675528 | 12/1963 | Canada | 162/357 |

*Primary Examiner*—Philip R. Coe
*Assistant Examiner*—Stephen F. Gerrity
*Attorney, Agent, or Firm*—Robert F. Palermo

[57] ABSTRACT

A press for dewatering papermaking pulp has a pair of adjacent perforated cylindrical rolls which define a continuously converging nip and a vat shell adjacent the rolls which provides enhanced bottom access to the press rolls by means of a door which is hinged to swing downward and away from the bottom of the press vat. A hoist mechanism raises and lowers the unhinged side of the door as required, and retractable keys latch the door in a sealing position against the vat. A shock absorber mechanism is provided to limit the speed at which the unhinged side of the door can fall when being lowered.

4 Claims, 7 Drawing Sheets

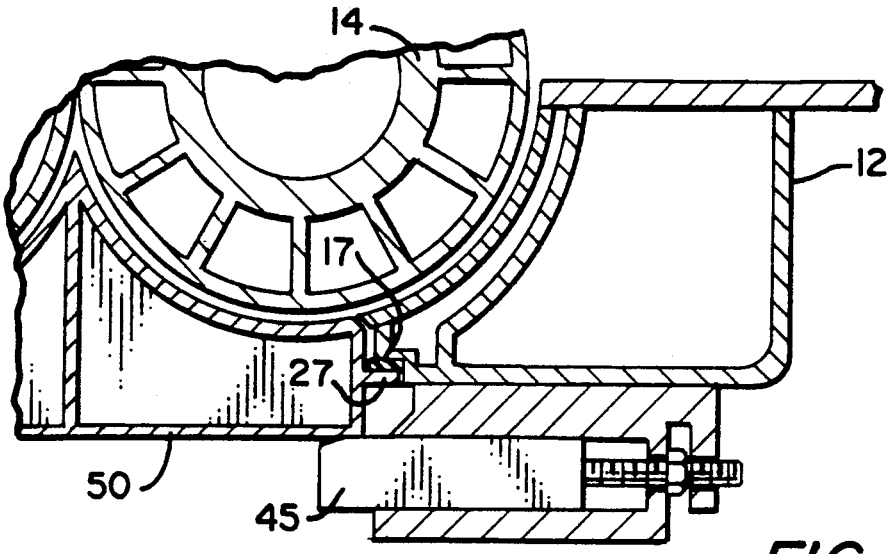
FIG. 7
FIG. 8
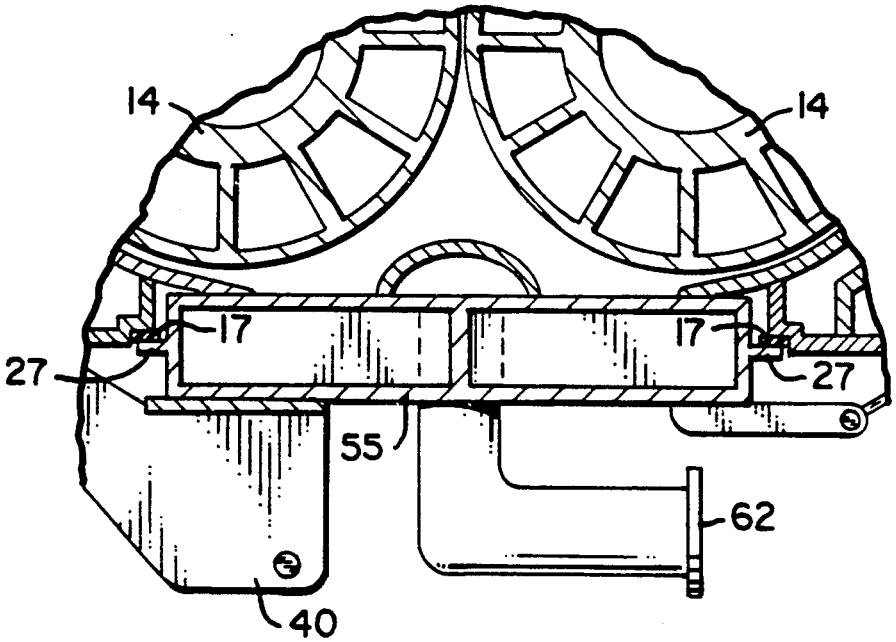

PULP PRESS VAT PROVIDING ENHANCED BOTTOM ACCESS

BACKGROUND OF THE INVENTION

This invention relates generally to processing of pulp for papermaking and more particularly to improvements in press vats for dewatering a papermaking pulp slurry.

Processing papermaking pulp requires exposure of the pulp to washing, various bleaching systems, flash drying, wet transport, alkali cellulose preparation, asphalt dispersion, high consistency fiber treatment, and other operations or combinations thereof. At various stages of the process, it is desirable to drastically increase the pulp consistency. This is usually accomplished by filtering, pressing, or combinations of the two operations.

One known pressing device consists of a cylinder formed from a perforated screen in which a constant pitch continuous flight tapered screw is driven to transport the pulp slurry. The low consistency pulp is usually gravity fed to the inlet of the press and is transported by the screw toward the outlet end of the press. As the pulp is conveyed along the screw in the ever decreasing screw chamber, it is also subject to the pressing action caused by the back pressure exerted by the discharge doors. In this process, it is possible to increase pulp consistency from a feed consistency of approximately three percent to a discharge consistency of approximately thirty percent.

Another effective device for dewatering pulp is the twin roll press, which has two closely spaced porous rolls between which the pulp is passed for dewatering. Typically, the pulp is fed under pressure, at a consistency of two to ten percent, to both rolls where it forms a mat and, by pressure filtration, its consistency is increased to approximately twelve to fifteen percent. Some such units have a so-called nip wedge below the rolls, which is rather closely contoured to the shape of the rolls and which serves to compact the pulp mat further as it approaches the nip between the rolls. While passing between the rolls, the pulp mat is severely compressed so that its consistency increases to as much as approximately fifty percent. It is then removed for further processing. During extreme compression some of the liquid in the pulp mat flows out of the nip forward but then falls back into the vat taking with it pulp fibers—if this does not occur the pulp mat can contact the nip wedge surface and adhere causing severe plugging.

Press units which are not equipped with the so-called nip wedge have a number of vat access doors, or manholes, in the vat bottom which provide a limited access to the underside of the rolls. These are required in order to clear occasional plugs which may occur if some of the dewatered pulp sheet sloughs off the rolls and accumulates to form a vat plug. If plugging is too severe, the vat access doors may not provide sufficient working room to clear the plug, in which case it may become necessary to disassemble the press. This is a very complex, costly, and time-consuming process.

One twin roll press provides improved access to the bottom of the rolls by use of a vat bottom door which can be lowered away from the vat bottom without disassembly. This improves access to the roll bottoms, but still requires that work be performed between the rolls and the vat bottom door which remains directly beneath the vat. Under these circumstances, it is still difficult to achieve access necessary to completely clear a severe plug.

The foregoing illustrates limitations known to exist in present pulp dewatering presses. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pulp dewatering press having a pair of adjacent perforated cylindrical rolls defining a continuously converging nip therebetween, a vat shell adjacent the rolls, and a pivotal door means on the shell bottom for providing access to the nip.

The foregoing and other aspects will become apparent from the following detailed description of the invention when considered in conjunction with the accompanying drawing figures.

BRIEF DESCRIPTION OF THE DRAWING FIGURES

FIG. 7 is a fragmentary partially sectioned view showing the key latch feature of the present invention.

FIG. 8 is a sectional schematic view of an alternative embodiment of the vat bottom of the present invention.

DETAILED DESCRIPTION

FIGS. 1, 2, 3, and 4 illustrate pertinent features of dewatering press vats of the prior art.

Figure 1:
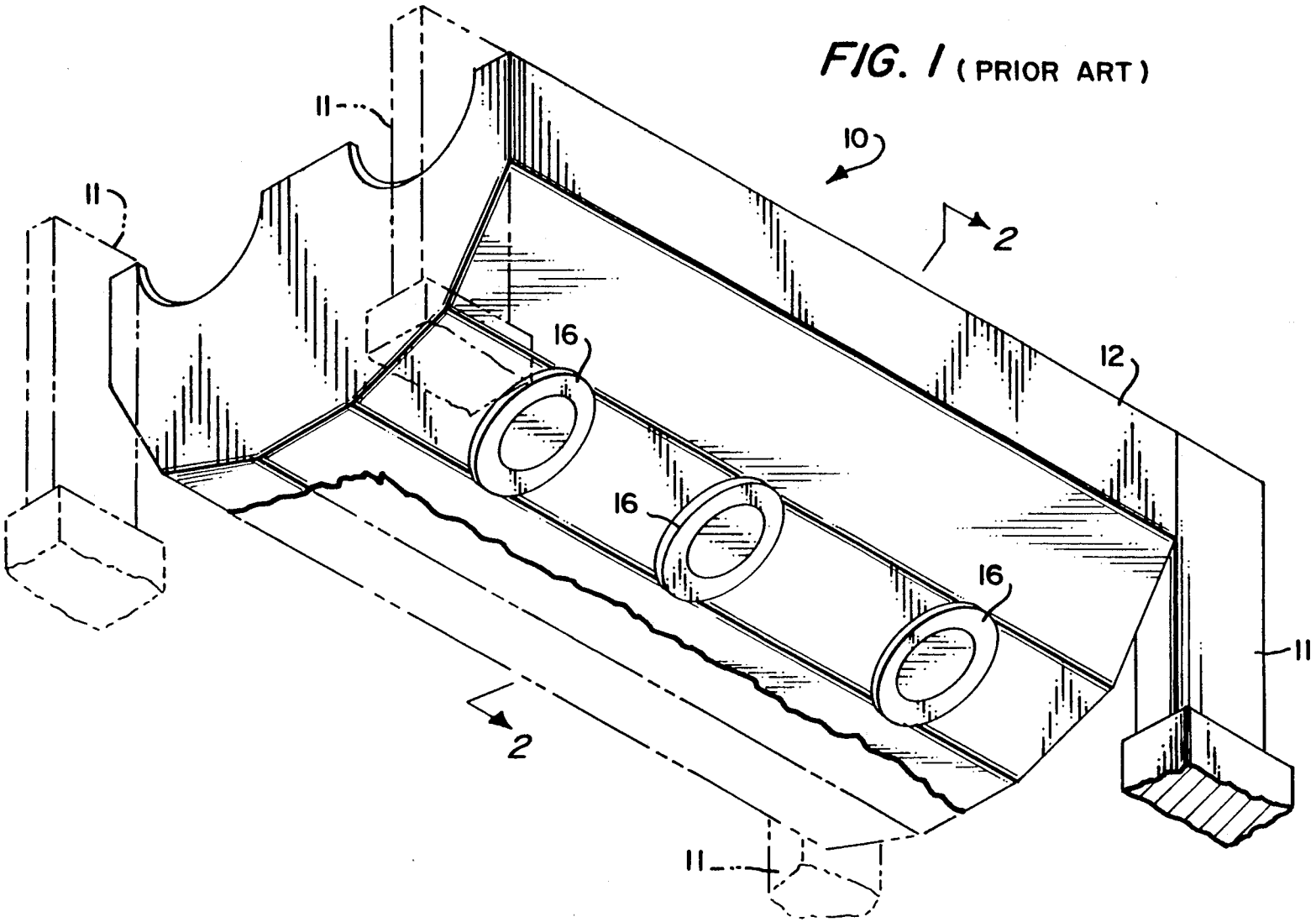
FIG. 1 (PRIOR ART)
FIG. 1 is a fragmentary schematic perspective underside view of a dewatering roll press vat of the prior art.
Figure 2:
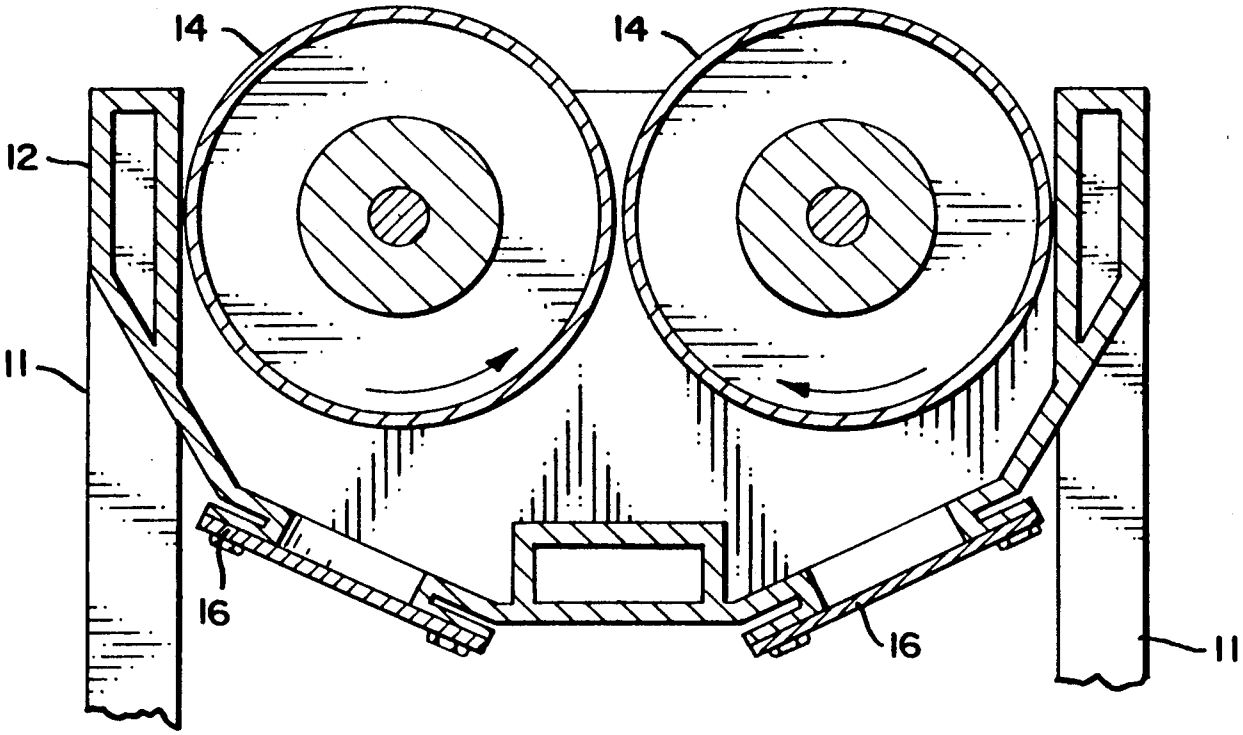
FIG. 2 (PRIOR ART)
FIG. 2 is a schematic sectional view from line 2—2 of FIG. 1.

Referring to FIGS. 1 and 2, some features of a roll press vat 10 are seen. The vat shell 12 is, essentially, the bottom half of the roll press housing. Vat shell 12 is shown supported on idealized vat supports 11. Press rolls 14 are illustrated together with vat access doors 16 which provide access to the nip area, or the area of closest proximity between rolls 14. Limitations on the access provided by vat access doors 16 can be readily appreciated considering that the press rolls 14 are generally of the order of one meter in diameter by four to five meters in length. This means that jam clearance can require a reach exceeding one meter into areas where visibility is limited or even nonexistent.

Figure 3:
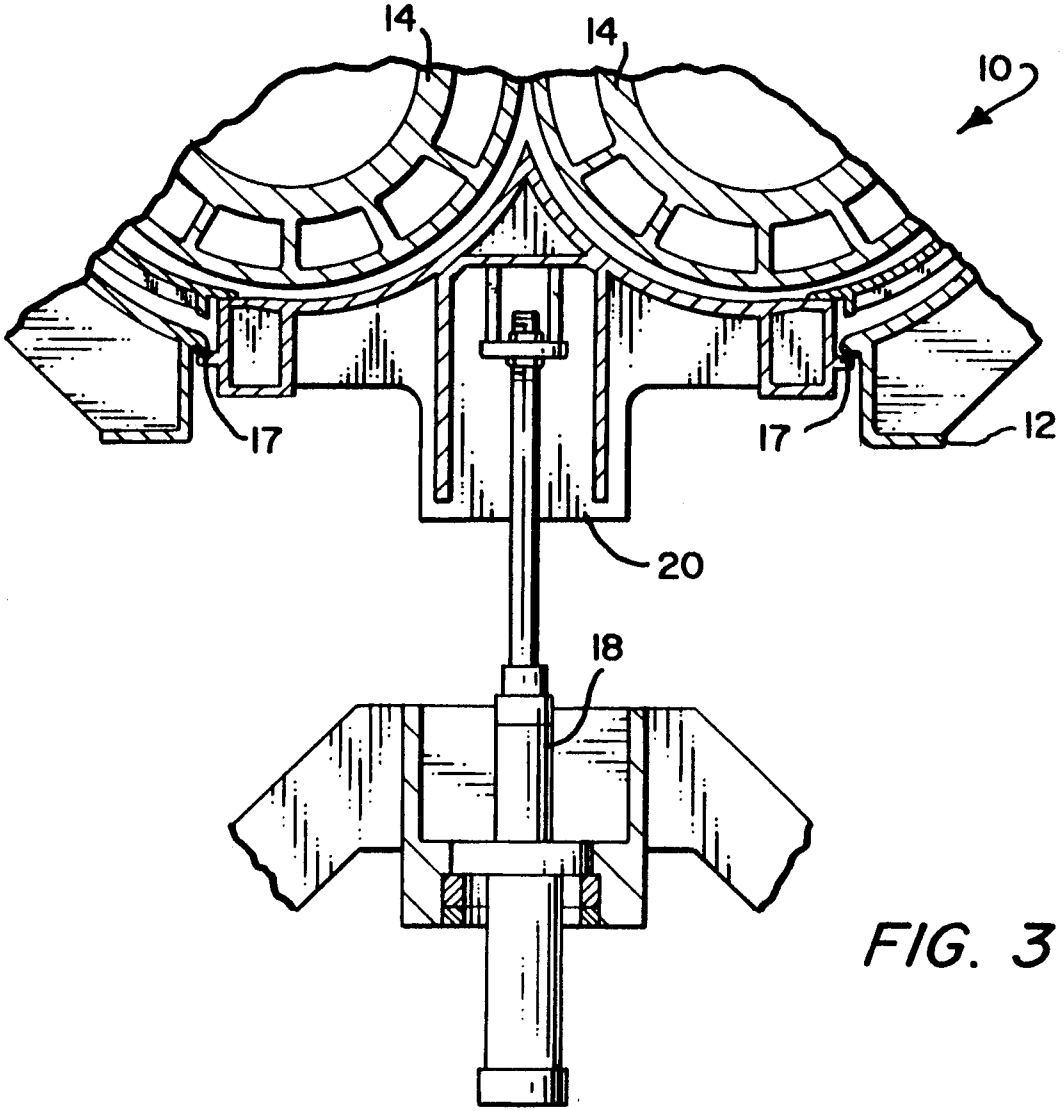
FIG. 3 (PRIOR ART)
FIG. 3 is a schematic sectional view of another roll press of the prior art featuring a fluid power operated bottom door mechanism.
Figure 4:
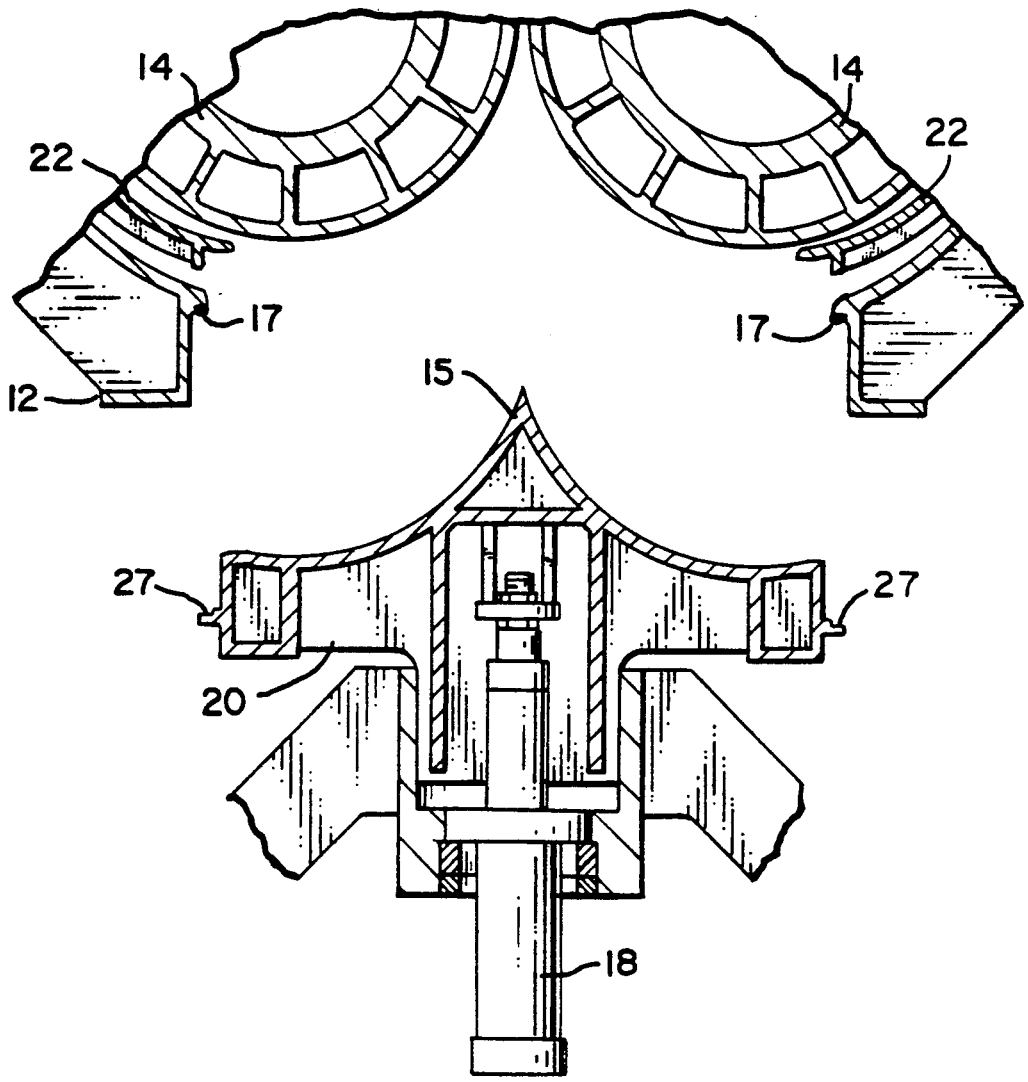
FIG. 4 (PRIOR ART)
FIG. 4 is a schematic cross sectional view of the door of FIG. 3 in its open position.

FIGS. 3 and 4 illustrate another roll press of the prior art. In this case, a large bottom door, operated by a fluid power cylinder mechanism, is provided. Vat shell 12, supported on vat supports 11, is equipped with bottom door 20 which is supported by hoist cylinder 18. Nip wedge 15, which converges toward the nip between press rolls 14, is an integral part of bottom door 20. In FIG. 4, hoist cylinder 18 is in its retracted position and, thus, bottom door 20 is in its lowered or open position. Seal 17, mounted on the bottom of vat shell 12, cooperates with seat 27 which is mounted on the periphery of bottom door 20. Nip wedge 15 is so formed that, when bottom door 20 is in the closed position, the arc of the nip wedge forms a smooth continuation of converging baffles 22. Note that, even in the open position, this door arrangement provides limited access to the roll nip for clearance of pulp jams. This is so because the bottom door 20, when open, is still directly below the rolls. In addition, retraction of the hoist cylinder is limited, further compounding the access limitation imposed by the location of bottom door 20 directly beneath vat shell 12. Furthermore, the assembled height of the hoist cylinder and press is very large resulting in an expensive installation.

Figure 6A:
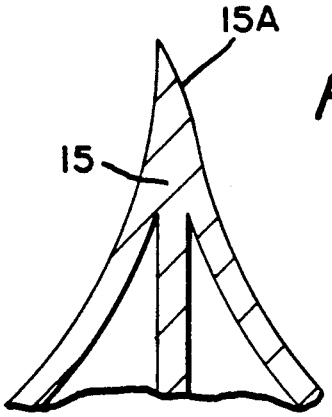
FIG. 6A is an enlarged detail view of the portion of the nip wedge in circle A of FIG. 6.
Figure 5:
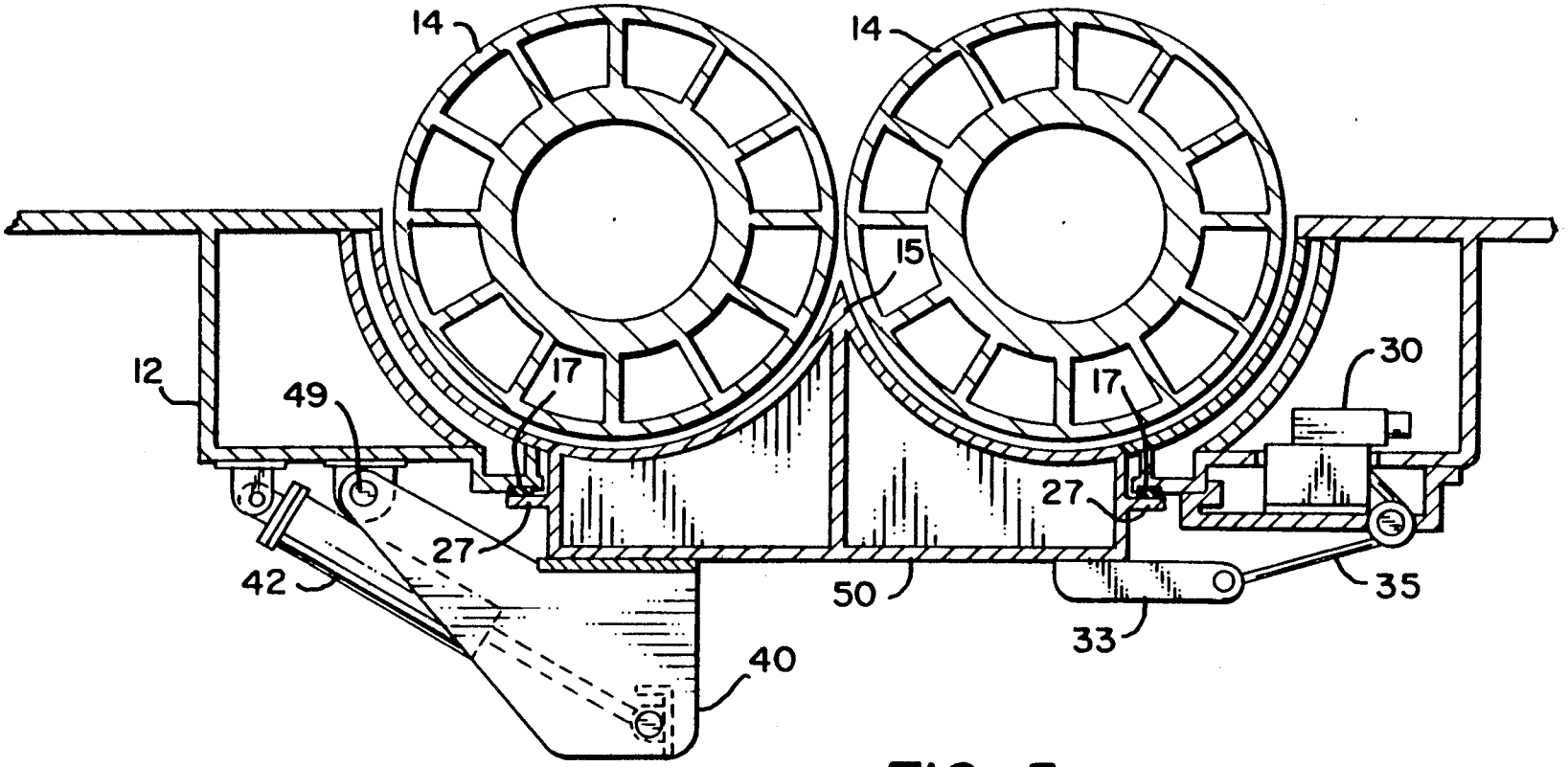
FIG. 5 is a sectional schematic view of the present invention.

FIG. 5 shows one embodiment of the present invention. Vat shell 12 is shown equipped with bottom door 50, in this case. Nip wedge 15 is an integral part of bottom door 50. In this case bottom door 50 is supported by hinge 40 on a first side of vat shell 12 and tether 35 which connects hoist 30 to tether arm 33. To lower or raise bottom door 50, hoist 30 is operated to pay out or take up tether 35 thereby controlling tether arm 33 and, thus, the movement of bottom door 50. Note that shock absorber 42, attached to hinge 40, limits the speed at which bottom door 50 can fall or be lowered. In this view, the arrangement of seal 17 on the bottom of vat shell 12 and cooperating seats 27 on bottom door 50 are clearly illustrated. Note that seals 17 are placed on a line which passes through the center of hinge pin 49. This is necessary to assure that the seals 17 are subjected to only compressive loads under seats 27 when bottom door 50 is closed. Also, the hinge location assures that no jamming occurs against the pulp plug to prevent the door swinging freely. FIG. 6A shows greater detail of the area of the nip wedge in circle A of FIG. 6. In this view, exaggerated for the sake of illustration, is shown a reverse arc 15A near the apex of the nip wedge 15. This reverse arc 15A is required to provide clearance for the nip wedge 15 to swing clear of roll 14 when being lowered.

FIG. 7 is a fragmentary view of the closure area of vat bottom 50 which illustrates the function of key 45 in latching the removable vat bottom 50 in place against vat shell 12.

FIG. 8 shows an alternative embodiment of the removable bottom of the present invention. In this case, the vat bottom door 55 has no nip wedge. This is because pulp stock is fed through stock feed pipe 60 into the bottom of the vat through bottom door 55. Since bottom door 55 is hinged, flange 62 is provided on stock feed pipe 60 in order to provide means for quickly connecting and disconnecting the stock feed when it is necessary to open bottom door 55. All other features of this embodiment are the same as those counterparts of the preferred embodiment.

Figure 6:
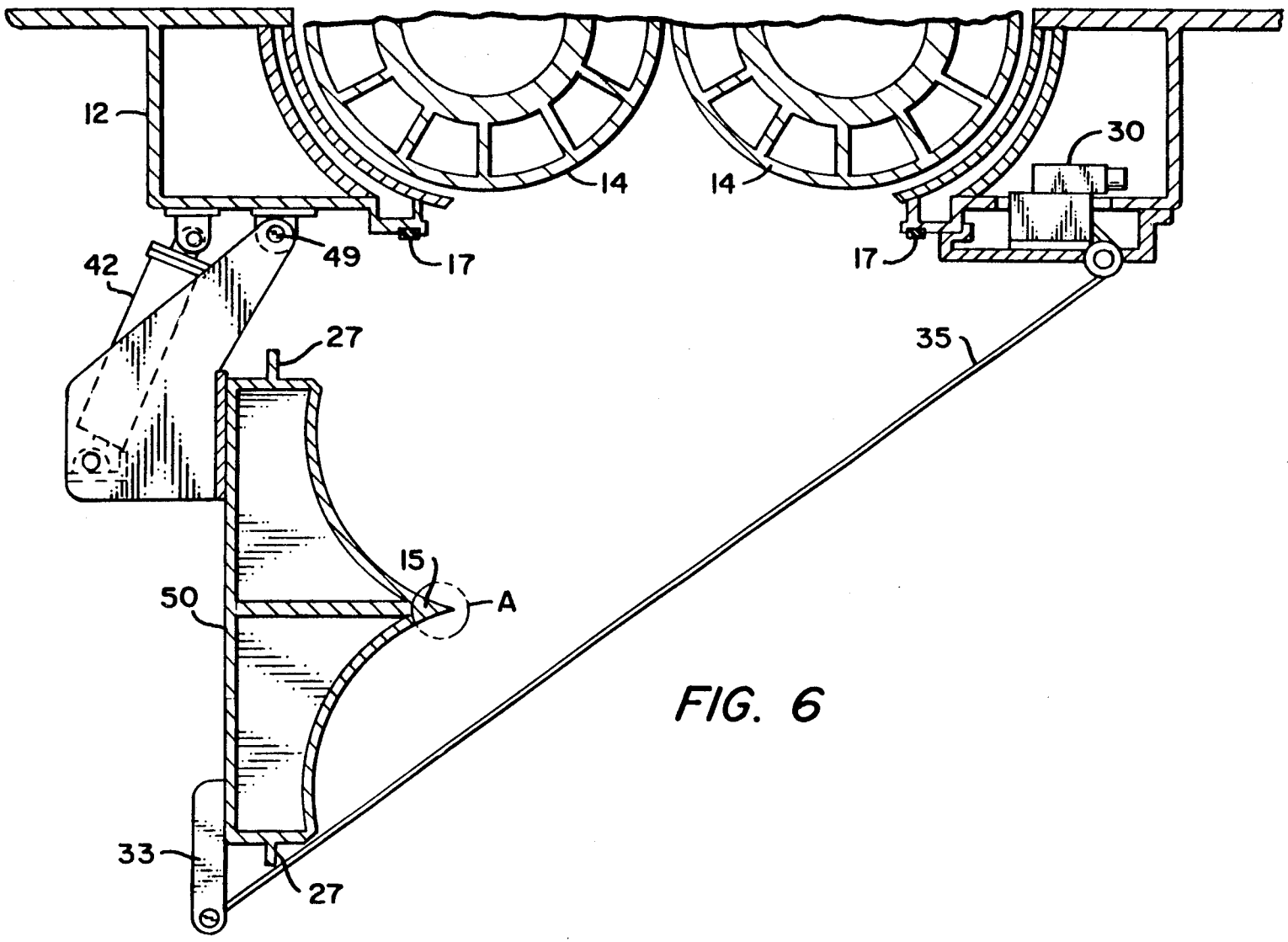
FIG. 6 is a sectional schematic view of the removable bottom of the present invention in its open position.

Comparison of FIGS. 1, 4, and 6 clearly illustrate the access advantage provided by the present invention. In the present invention the bottom door 50 is swung completely clear of the area of roll nip. Thus, rapid easy access is provided for personnel and equipment to perform efficient clearance of pulp plugs and to maintain the bottom door and its actuating parts.

What is claimed is:

1. A pulp dewatering press comprising:

a pair of adjacent perforated cylindrical rolls defining a continuously converging nip therebetween;

a vat shell adjacent the rolls; and a pivotal door means on the shell bottom for providing access to the nip and having a nip wedge with a shape substantially conforming to the nip and a portion of the adjacent perforated cylindrical rolls except for a reverse arc on one side of said nip wedge near a region of convergence thereof.

2. In combination with a pulp dewatering press having a pair of adjacent perforated cylindrical rolls defining a continuously converging nip therebetween and a vat shell bottom adjacent the rolls, the vat shell bottom having a first and a second side defining an opening therebetween, the improvement comprising:

door means for selectively providing a closure for the opening in the vat shell bottom, said door means being pivotally connected by one or more hinges to said first side and latchable with said second side, whereby when said door is pivoted to an open position, access to the nip is provided;

hoisting means for moving the unhinged side of the door means; and means for limiting the speed at which the unhinged side of said door means can be lowered.

3. The combination of claim 2, wherein the hoisting means comprises a winch and a tether extending between said winch and a tether arm on said door means.

4. The combination of claim 3, wherein the door means includes a nip wedge having a shape substantially conforming to the nip and a portion of the adjacent perforated cylindrical rolls and having a reverse arc near the nip on one side of the nip wedge facing said second side of said vat shell bottom.

* * * * *